US005367553A

United States Patent [19]

d'Achard Van Enschut et al.

[11] Patent Number: 5,367,553

[45] Date of Patent: Nov. 22, 1994

[54] X-RAY TUBE COMPRISING AN EXIT WINDOW

[75] Inventors: Johannes F. M. d'Achard Van Enschut; Theodorus J. J. M. Jenneskens; Antonius H. M. Swemmers, all of Eindhoven, Netherlands

[73] Assignee: U.S. Philips Corporation, New York, N.Y.

[21] Appl. No.: 646,954

[22] Filed: Jan. 25, 1991

[30] Foreign Application Priority Data

Jan. 29, 1990 [NL] Netherlands ..... 9000203

[51] Int. Cl.[5] ..... H01J 35/00

[52] U.S. Cl. ..... 378/137; 378/136

[58] Field of Search ..... 378/136, 137, 138, 141, 378/147, 119, 121, 122, 129

[56] References Cited

U.S. PATENT DOCUMENTS

| | | | |
|---|---|---|---|
| 2,679,017 | 5/1954 | Rogers et al. | 378/136 |
| 3,517,195 | 6/1970 | Leavitt | 378/136 |
| 4,017,757 | 4/1977 | DeCou, Jr. | 378/134 |
| 4,870,671 | 9/1989 | Hershyn | 378/134 |

FOREIGN PATENT DOCUMENTS

| | | | |
|---|---|---|---|
| 0275592 | 12/1987 | European Pat. Off. | H01J 35/06 |
| 2749856 | 5/1979 | Germany | 378/136 |
| 3524379 | 2/1986 | Germany | G01T 1/36 |
| 0015633 | 7/1969 | Japan | 378/136 |
| 0204453 | 11/1983 | Japan | 378/136 |
| 0097241 | 5/1987 | Japan | 378/137 |

OTHER PUBLICATIONS

Heritage et al "Electron Gun for Generating x-rays", Nov., '74, p. 1823.

J. L. Gaines et al., "An Improved Annular-Shaped Electron Gun for An X-ray Generator", Nuclear Instruments & Methods, 126, (1975), pp. 99-101 (North-Publishing Co.).

*Primary Examiner*—Paul M. Dzierzynski
*Assistant Examiner*—Don Wong
*Attorney, Agent, or Firm*—Anne E. Barschall

[57] ABSTRACT

An electron-optical system directs an electron beam which emanates, for example from a line-shaped or annular emissive cathode element, onto an anode target face in a collimated fashion so that a large part of reflected electrons is incident on the target face again, thus contributing to the generating of X-rays. The construction of the electron-optical system and the high degree of re-incidence of scattered electrons allows for a minimum distance between the anode target face and the exit window. A filament of the cathode may be constructed so as to achieve an optimally uniform operating temperature over a comparatively large part of its length.

12 Claims, 2 Drawing Sheets

X-RAY TUBE COMPRISING AN EXIT WINDOW

Field of the Invention

The invention relates to an X-ray tube, comprising a cathode, an anode and an electron-optical device which are accommodated in an envelope comprising an exit window.

BACKGROUND OF THE INVENTION

An X-ray tube of this kind is known from U.S. Pat. No. 3524379. It is drawback of a tube described therein that the distance between the anode and the exit window must be comparatively long or that the tube has a comparatively low efficiency due to a limited X-ray yield of an electron beam to be directed onto the anode, which is due to the focus geometry and shadowing.

EP 275592 discloses an X-ray tube which mitigates the above drawbacks by utilizing an exit window which also acts as an anode. Even though a minimum distance is thus realized between the anode target face and the exit window, the operation of such a tube is not satisfactory in cases where a comparatively intensive X-ray beam is required. This is not so much due to the low efficiency between electron beam and radiation yield, but rather to a limited electron loadability of a sufficiently thin exit window.

SUMMARY OF THE INVENTION

It is an object of the invention to mitigate the described drawbacks; to achieve this, an X-ray tube of the kind set forth in accordance with the invention is characterized in that the electron-optical device is adapted to generate a field which collimates an electron beam emanating from the cathode and which directs the beam onto an anode target face via a trajectory including an inversion point at an angle of at least approximately 45°.

Because the electron beam in an X-ray tube in accordance with the invention is incident on the anode target face in a collimated fashion at a comparatively large angle with respect to the target face, a high efficiency can be realised between the electron current and the generated X-rays even for a small distance between the anode and the window.

In a preferred embodiment, the electron-optical device is adapted to generate a potential field which directs the electron beam onto the anode target face at a comparatively large angle, notably near 90°. It is thus achieved that the majority of the electrons reflected from the anode surface are incident on the anode surface again at a slight distance from the point of incidence. As a result, the anode target face, and hence a relevant dimension of the entire tube, i.e. the cross-section, can be reduced, so that a higher degree of freedom is achieved as regards positioning in an analysis apparatus.

The anode target face in a preferred embodiment constitutes an end face of a cylindrical anode member, the exit window being arranged so as to face the anode member, the cathode being arranged to the side of the anode member. The exit window is situated notably substantially parallel to the anode target face. A structural geometry thus cannot. influence the distance between the anode and the exit window.

For electron beam collimation the electron-optical system of a preferred embodiment comprises an auxiliary electrode which is arranged to the side of the anode target face and which is shaped as a ring in the case of an annular cathode and as a strip in the case of a linear cathode.

Inter alia because of this electrode geometry, a high degree of efficiency can be achieved in combination with a comparatively high degree of freedom as regards the distance between the anode and the window which is notably limited to a minimum value which is given by the required breakdown strength.

In a further preferred embodiment the cathode is accommodated in a cathode housing, a beam aperture thereof forming part of the collimating electron-optical system. Notably an emissive element of the cathode is situated at a substantial distance from the aperture. An additional advantage of this construction consists in that the deposition of filament material on the exit window is reduced. For electron beam control use can also be made of a control electrode which is arranged at a rear side with respect to an emission side of the cathode. The emissive element is formed notably by an annular filament. In order to increase the service life of the filament, supports for the filament are constructed and located so as to optimize the uniformity of the filament temperature. The filament of the cathode may be circular, in which case the anode member also has a circular cross-section. The cathode filament as well as the anode member may alternatively have a non-circular shape, for example the shape of a possibly rounded square. The cathode filament may also extend along a straight line segment, notably for the formation of a line focus on an adjacently arranged anode target face. For the formation of an elongate or more generally a non-circular focus, the cathode filament and preferably also the anode member may be constructed so as to be substantially elliptical, the eccentricity being, for example 4.

In a preferred embodiment the electron-optical system is constructed so that a majority of the electrons reflected by the anode target face are incident again on the anode target face. The first focus formed by the electron-optical system then constitutes a ring across the anode target face, which ring has a diameter which depends inter alia on the electron angle of incidence and the radial speed of incidence.

BRIEF DESCRIPTION OF THE DRAWING

Some preferred embodiments in accordance with the invention will be described in detail hereinafter with reference to the drawing.

DESCRIPTION OF THE PREFERRED EMBODIMENT

Figure 1:
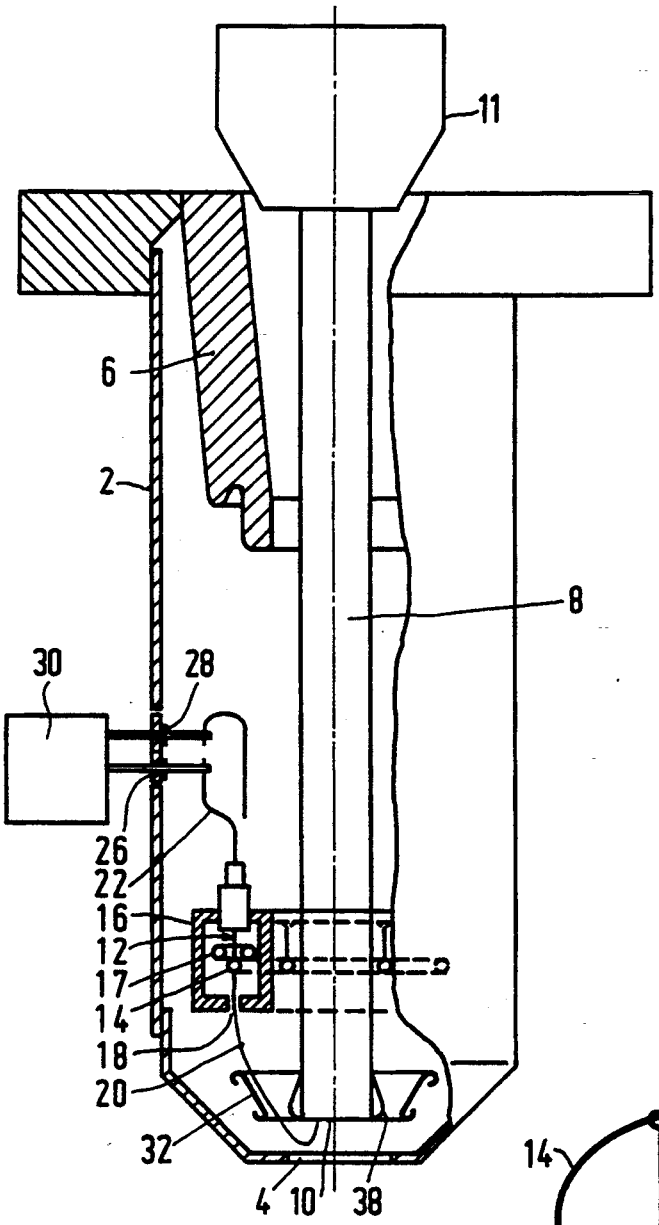
FIG. 1 is a partial sectional elevation view of an X-ray tube according to an embodiment of the present invention.

In FIG. 1, an X-ray tube comprise an envelope 2 in which; an exit window 4 is arranged at a first end, a socket 6 being provided at a second end. The exit window 4 comprises, for example, a beryllium plate having a thickness of, for example 125 μm. An anode member 8 is centrally arranged in the envelope 2. At its end which faces the exit window 4, the anode member 8 supports an anode target face 10, the anode member 8 supporting a high-voltage connector 11 at the opposite end. Adjacent the cylindrical anode member 8, which may have a round, a rectangular, an elliptical or another cross-section, there is arranged a cathode 12. In the present embodiment the cathode 12 comprises an annular filament 14 which is included in a cathode housing 16 having an annular beam aperture 18, which cathode housing 16 may also accommodate a control electrode. An electron beam 20 to be emitted by the filament 14 emanates from the cathode housing 16 via the beam aperture 18. The filament 14 is connected, by way of conductors 22 and 24, (FIG. 1*a*) to a cathode current supply source 30, via wall passages 26 and 28. The electron beam 20 emitted by the emitter filament 14 is radially collimated by means of the aperture 18 which acts as an electron lens. Further collimation and alignment of the beam 20 can be achieved by means of an auxiliary electrode 32 and a collar 38 in the form of a thickened portion or a reduced portion of the anode member 8. Additional collimation can be imparted to the beam 20 by way of the shape and potential of the auxiliary electrode 32 and by the a shape of the collar 38. The beam can be directed as a ring 40 on the anode target face 10 at a desired angle. The ring 40 is preferably chosen so that electrons which are reflected upon first incidence are for the better part incident again on the anode target face 10. The efficiency is thus enhanced and undesirable heating and other disturbances by reflected electrons are avoided. The anode target face 10 is at a minimum distance from window 4, the distance being determined by an electrostatic potential difference between the anode and exit window. This distance is reduced by the re-incidence of scattered electrons.

Figure 1A:
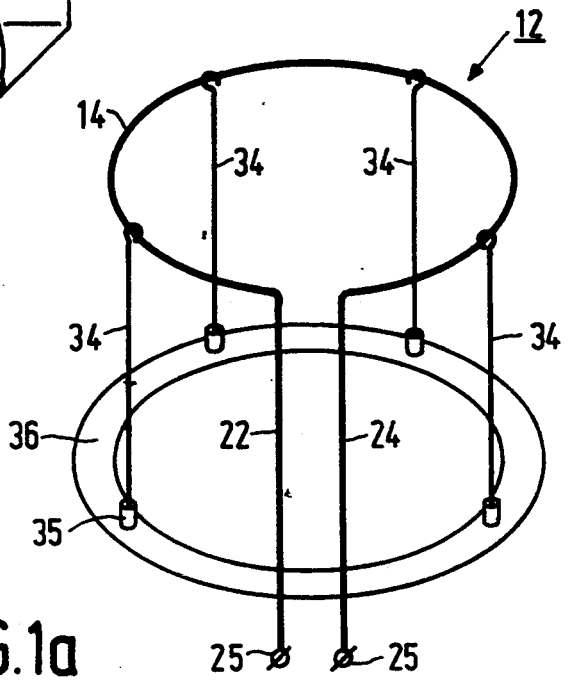
FIGS. 1*a* and 1*b* show an example of a filament which serves as an electron emitter for an X-ray tube as shown in FIG. 1.
Figure 1B:
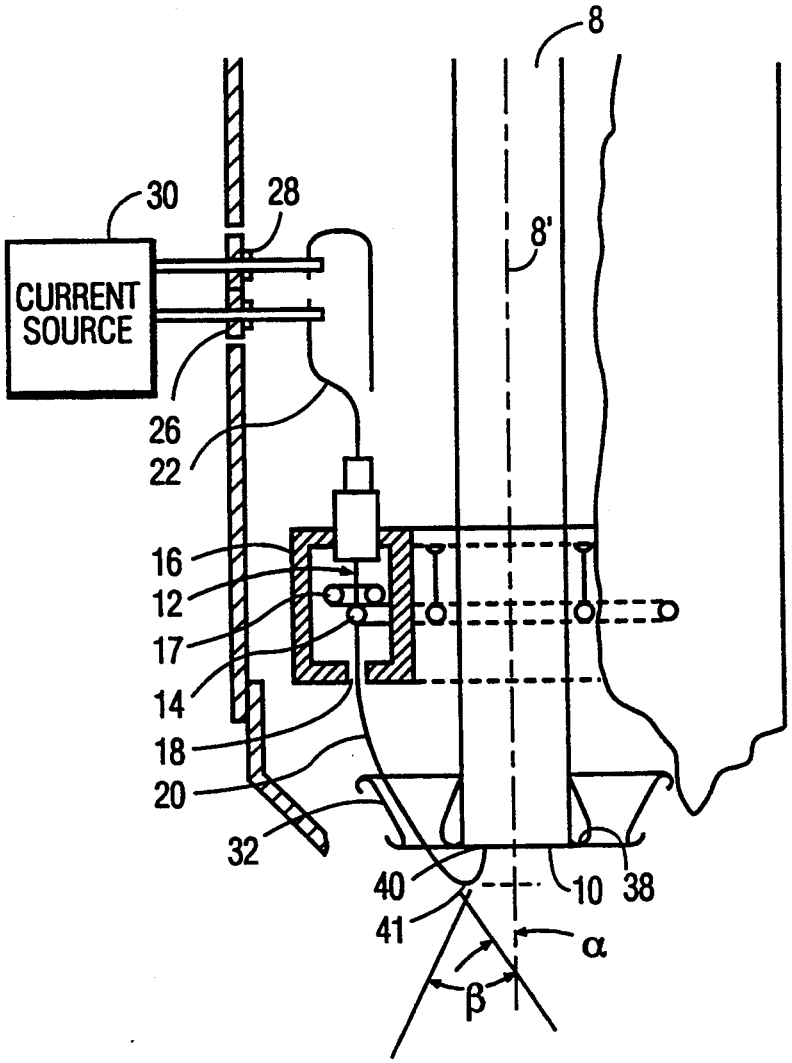

Using supports 34, FIG. 1*a*, which are clamped in a cooled portion 36 of the cathode housing in an insulated manner, for example via pins 35, the filament 14 is retained in a fixed position. The conductors 22 and 24 can also serve as positioning supports. To this end, these conductors may be constructed so as to be comparatively rugged and may be provided with heat shields. As a result, a substantial local cooling of the filament 14 occurs along the conductors 22 and 24. The shape, composition and notably position, measured along the filament 14, are determined in accordance with the invention so that comparatively large portions of the filament 14 which extend between supports 34 exhibit an optimum uniform temperature near the desired emission temperature during operation, notably temperature differences between the various segments of the filament 14 being minimized. As a result, the service life of the X-ray tube can be substantially extended for the same circumstances. In known annular filament cathodes burning of the filaments occurs faster because this process is strongly positive in a sense that a comparatively hot location assumes a higher resistance, and therefore becomes hotter again, so that it evaporates more quickly and hence obtains a higher temperature again, etc. In the described embodiment the filament 14 has a circular shape, but it may also have another shape, for example it may be shaped as a straight line segment. In Fig. 1*b*, the beam 20 emanating from the cathode 12 via beam aperture 18 is collimated by the aperture 18. The beam 20 follows a field induced trajectory to an inversion point 41 following path at an angle $\alpha$ of least 45° with the side of envelope 2 and the axis 8' of member 8. The trajectory beam 20 follows an inverted field induced path which encloses an angle $\beta$ of about 90° as the electrons are inverted toward the fact 10 at point 41.

Because the electron beam 20 in the X-ray tube is incident on the anode target face 10 in a collimated fashion at a comparatively large angle, for example, angle $\alpha$ at about 45° with respect to the target face 10, a high efficiency is realized between the electron beam current and the generated X-rays even for a small distance between the anode 8 and the axis window 4.

The electron-optical device is adapted to generate a potential field via filament 14 and electrode 32 which direct the electron beam 20 onto the anode target face 10 at the comparatively large angle $\alpha$. The majority of the electrons reflected from the anode surface face 10 and ring 40 are incident on the anode surface face 10 at a slight distance from the point of incidence of ring 40. As a result, the anode target face 10, and hence a relevant dimension of the entire tube, i.e. the cross-section, can be reduced, so that a higher degree of freedom is achieved as regards positioning in an analysis apparatus.

The anode target face 10 comprises an end face of the cylindrical anode member 8, the exit window 4 being arranged so as to face the anode member 8, the cathode 12 being at the side of the anode member 8. The exit window 4 is situated substantially parallel to the anode target face. This comprises a structural geometry which does not exhibit different distances between the anode 8 and the exit window 4.

For electron beam collimation, the auxiliary electrode 32 is at the side of the anode, target face 10 and is shaped as a ring for use with the annular cathode 12 and may be formed as a strip in the case of a linear cathode.

Because of this electrode geometry a high degree of efficiency is achieved in combination with a comparatively high degree of freedom as regards the distance between the anode 8, face 10 and the window 4 which has a minimum value given by the required breakdown strength.

The cathode 12 is accommodated in the cathode housing 16, the beam aperture 18 thereof forming part of the collimation electron-optical system. An emissive element filament 14 of the cathode 12 is situated at a substantial distance from the aperture 18. An additional advantage of this construction is that the deposition of filament 14 material on the exit window 4 is reduced. For electron beam control use is also made of a control electrode at a read side with respect to the emission side of the cathode 12. The cathode 12 emissive element is preferably formed by annular filament 14. In order to increase the service life of the filament 14, the supports 34 for the filament are located so as to optimize the uniformity of the filament 14 temperature. The filament 14 of the cathode 12 may be circular, in which case the anode member 8 also has a circular cross-section. The cathode filament 14 as well as the anode member 8 may alternatively have a non-circular shape, for example a rounded square. The cathode filament may in the alternative, also extend along a straight line segment, for the formation of a line focus on an adjacently arranged anode target face. For the formation of an elongate or more generally a non-circular focus, the cathode filament and preferably also the anode member may be constructed so as to be substantially elliptical, the eccentricity being, for example about 4:1.

In a preferred embodiment the electron-optical system is constructed so that a majority of the electrons reflected by the anode target face 10 are incident again on the anode target face 10. The first focus formed by the electron-optical system then constitutes the ring 40 across the anode target face, which ring 40 has a diameter which depends on the electron angle $\alpha$ of incidence and the radial speed of incidence.

We claim:

1. An x-ray tube comprising:

an envelope having a radiation exit window and accommodating therein a cathode, an anode, and electron-optical means in the envelope having an electron beam exit window for generating a field which collimates an electron beam emanating from the cathode and for directing the beam onto the anode at an angle of at least approximately 45°, via a field induced trajectory having an inversion point.

2. An X-ray tube as claimed in claim 1 including an anode member, the anode member having a target face, the anode target face comprising and end face of the anode member, the cathode being arranged adjacent to the anode member.

3. An X-ray tube as claimed in claim 2 wherein the anode target face extends substantially parallel to the exit window.

4. An X-ray tube as claimed in claim 3 wherein the electron-optical means comprises an annular auxiliary electrode which is situated adjacent to and near the anode target face for further collimation of the collimated electron beam.

5. An X-ray tube as claimed in claim 4 wherein the anode target face is situated at a minimum distance from the exit window, which distance is determined by an electrostatic potential difference between the anode and the exit window.

6. An X-ray tube as claimed in claim 2 wherein the anode target face is situated at a minimum distance from the exit window, which distance is determined by an electrostatic potential difference between the anode and the radiation exit window.

7. An X-ray tube as claimed in claim 6 wherein said electron-optical means includes a cathode housing, the cathode being accommodated in the cathode housing which is constructed to form a electron beam by a collimating effect.

8. An X-ray tube as claimed in claim 7 wherein the cathode comprises an annular emissive element.

9. An X-ray tube as claimed in claim 8 wherein the cathode comprises a filament provided with supports which are constructed, dimensioned and located so that a comparatively large part of the filament is at a uniform temperature in the vicinity of an emission temperature of the cathode.

10. An X-ray tube as claimed in claim 1 wherein said electron-optical means includes a cathode housing, the cathode being accommodated in the cathode housing which is constructed to form an collimated electron beam by a collimating effect.

11. An X-ray tube as claimed in claim 1 wherein the cathode comprises an annular emissive element.

12. An x-ray tube as claimed in claim 1 wherein in the cathode a filament is provided with supports which are constructed, dimensioned, and located so that the portion of the filament between the supports is at a uniform temperature in the vicinity of an emission temperature of the cathode.

* * * * *